US007934534B2

(12) United States Patent
Laempe

(10) Patent No.: US 7,934,534 B2
(45) Date of Patent: May 3, 2011

(54) METHOD AND DEVICE FOR PRODUCING MOULDS OR CORES, IN PARTICULAR FOR FOUNDRY PURPOSES

(75) Inventor: Joachim Laempe, Schopfheim (DE)

(73) Assignee: Laempe & Mossner GmbH, Meitzendorf (DE)

( * ) Notice: Subject to any disclaimer, the term of this patent is extended or adjusted under 35 U.S.C. 154(b) by 587 days.

(21) Appl. No.: 12/090,410

(22) PCT Filed: Sep. 21, 2006

(86) PCT No.: PCT/EP2006/009180

§ 371 (c)(1),
(2), (4) Date: Apr. 16, 2008

(87) PCT Pub. No.: WO2007/062706

PCT Pub. Date: Jun. 7, 2007

(65) Prior Publication Data

US 2008/0277089 A1 Nov. 13, 2008

(30) Foreign Application Priority Data

Dec. 1, 2005 (DE) ..... 10 2005 057 724

(51) Int. Cl.
*B22C 15/20* (2006.01)

(52) U.S. Cl. ..... 164/20

(58) Field of Classification Search ..... None
See application file for complete search history.

(56) References Cited

U.S. PATENT DOCUMENTS

| | | | |
|---|---|---|---|
| 5,494,094 | A | 2/1996 | Jacobsen |
| 2004/0250977 | A1 | 12/2004 | Stauder |

FOREIGN PATENT DOCUMENTS

| | | |
|---|---|---|
| DE | 4442846 | 6/1995 |
| DE | 19911374 | 11/1999 |
| DE | 10144193 | 10/2002 |
| DE | 10340491 | 3/2005 |
| EP | 1512472 | 3/2005 |
| FR | 2687942 | 2/1992 |
| WO | 9947295 | 9/1999 |

*Primary Examiner* — Jessica L Ward
*Assistant Examiner* — Steven Ha
(74) *Attorney, Agent, or Firm* — Volpe and Koenig, P.C.

(57) ABSTRACT

To produce moulds or cores for foundry purposes from a mixture (M) of moulding material or sand and a binder, the mixture (M) is shot using a shooting unit (2) or from a shooting tube (3) and a shooting head (4) through at least one discharge opening (7) arranged on a shooting plate (5) into a moulding or core tool (8). The region of the discharge opening (7) is moistened and/or kept moist by a liquid between at least two shooting operations, where the liquid (15) used for moistening is atomized by at least one ultrasonic atomizer (16) to form an aerosol capable of suspension and is fed to the discharge opening (7) directly or indirectly, for example, via one or more lines (18, 23).

4 Claims, 1 Drawing Sheet

METHOD AND DEVICE FOR PRODUCING MOULDS OR CORES, IN PARTICULAR FOR FOUNDRY PURPOSES

BACKGROUND

The invention relates to a method to produce moulds or cores, in particular for foundry purposes, from a mixture of sand or moulding material and a binder, which is particularly water soluble and/or hydroscopic, with the mixture being shot in a shooting process into a molding or core tool by at least one shooting unit through at least one discharge opening arranged at a shooting plate and subsequently hardened, and with the area of the discharge opening being moistened and/or kept moist at least via a liquid or water between two shooting processes.

The invention further relates to a device to produce moulds or cores, in particular for foundry purposes, made from a mixture of sand or a moulding material and a preferably inorganic binder, which is preferably water soluble and/or hydroscopic, having at least one discharge opening and a shooting unit provided with a shooting head, with a shooting plate with at least one discharge opening being provided at the shooting head and a device its fastened to, particularly to perform the above-mentioned method.

A method and a similar device are known from DE 103 40 491 B3. Here, a method is provided for carrying this out such that the moisture is fed in form of a finely distributed and/or sprayed or atomized liquid. However, it has shown that here too much liquid can enter the area of the shooting openings or discharge openings and can dissolve the binder out of the mixture of sand or binder or wash it out and/or can render the mixture of sand and binder, which is located in and/or slightly above the shooting openings or discharge openings, too moist so that within the moulding or core tool differently moist mixture areas of sand or molding material and binder can be present, leading to irregularities of the mould or the core.

From DE 101 44 193 C1 it is known to make a moisture carrier contact the filling elements to create a moist atmosphere during the injection molding, which for example may be an absorbent material saturated with a liquid or water. Thereby the shooting opening and the mixture of sand and binder also becomes too wet, which can lead to irregularities in the mixture.

Further, DE 101 44 193 C1 discloses that the moisture supplied shall act as a condensate, which in turn in the area of the shooting opening or discharge opening of a filling element can largely lead to a dilution of the mixture of sand and binder with the above-mentioned disadvantages.

SUMMARY

Therefore the object is to provide a method and a device of the type mentioned at the outset, by which a premature hardening of the mixture of core sand or molding material and binder is avoided in the area of the shooting opening or discharge opening and thus a low maintenance, constant operation is enabled without the binder becoming too moist or even being washed out.

In order to attain this object, the method defined at the outset provides that the liquid serving to moisten or the water serving to moisten the mixture is atomized into a suspendable aerosol by way of ultrasound and fed to the area of the shooting opening and/or the shooting unit or the shooting head.

It has shown that by using ultrasound, a liquid, for example an aqueous liquid or water, can be transferred into a suspendable aerosol, with its liquid components being so small that they change into humidity without condensing and without precipitating as a condensate in the area of the shooting opening for the sand-binder mixture. The size of the liquid particles created by ultrasound may amount to a size of 0.01 millimeter or less. Simultaneously sufficiently high humidity is achieved, preventing the dehydration of the sand-binder mixture between two shooting processes, for example, so that the individual shots can occur in a secure process without unevenly moist areas developing in the mould or the core.

The aerosol and/or the amount of said suspendable aerosol and the volume of the flow provided with said aerosol can be adjusted by changing the pulse packages emitted by the ultrasound generator(s) and/or by changing the voltage of the ultrasound generator(s). In this way, the amount of the suspendable aerosol, by which the area of the shooting opening (s) is moistened, can be adjusted to the environmental conditions, such as atmospheric humidity, number of shooting openings, and ambient temperature.

A particularly beneficial embodiment of the method according to the invention may comprise that the suspendable aerosol is formed at a distance from the shooting opening(s) and is supplied via a line to the shooting opening(s). In this way, the area of the shooting unit requires no space for creating said aerosol. However, in the area of the shooting openings, a sufficient amount of humidity must be provided so that any closure of the shooting openings by dehydration is avoided without supplying too much moisture, which particularly could wash out or dissolve the binder, perhaps.

Another particularly advantageous embodiment of the method according to the invention may comprise that the sand supply in the shooting tube and/or in the shooting head is moistened with a liquid aerosol. The shooting tube and/or the shooting head can therefore be connected to an ultrasound atomizer for liquids or water via one or more tubes, so that also the sand supply and particularly its surface being moistened, which otherwise could form a crust without becoming saturated, which can occur in addition to directly moistening the shooting opening or instead thereof indirectly moistening the shooting opening.

In order to attain the object, the device defined at the outset is characterized in that it is provided with at least one ultrasound atomizer for water or for a liquid, particularly comprising water, and that the ultrasound atomizer is connected to the discharge opening(s). The invention therefore uses the fact or teaching that ultrasound generators can vaporize water or a water-comprising liquid such that the individual droplets are smaller than one 20-thousandths of a millimeter or even smaller than 10-thousandths of a millimeter, so that they transfer into humidity and do not precipitate as a liquid film on parts of the shooting unit and particularly in the area of the shooting opening.

Here, it is particularly useful when the ultrasound generator(s) and the liquid reservoir allocated thereto are arranged spatially separated from the shooting unit and are connected to the area of the shooing opening(s) via at least one tubular or hose connection. Experiments have shown that the suspended aerosol formed by an ultrasound atomizer from water or a water containing liquid can be transported without any problems over several meters through such a line in order to then provide sufficiently moist air to the shooting opening(s), preventing the dehydration of the mixture of sand or moulding material and binder, in particular in the shooting openings, without the mixture becoming saturated to an excessive extent. In this way, advantageously the liquid reservoir with the ultrasound generator can be arranged at a location of the moulding or core shooting machine and/or near said machine at a location having sufficient space.

In order to transport the aerosol from the ultrasound atomizer(s) to the shooting opening(s) of the shooting unit, a fan and/or a pressure connection can be arranged, particularly above the surface of the liquid of the liquid reservoir. Although, based on its inert pressure, the aerosol could flow to the shooting openings, primarily in relatively short tubes, a fan or a pressurized gas connection can improve this flow and/or allow a greater distance of said ultrasound generator from the shooting openings. Further, by using a fan and/or a pressurized gas connection, differences in height between the ultrasound atomizer and the shooting plate and/or another target of the aerosol at the core shooting machine can be overcome. Primarily, the aerosol can also be transported upwards, so that the ultrasound generator with the liquid reservoir can be arranged lower, where generally sufficient place is available for it. Here, it is advantageous that a potentially occurring condensate at the interior walls of the tube or hose, in which the aerosol is transported, can reflux into the reservoir.

Therefore it is particularly beneficial when the liquid reservoir is a closed liquid vessel and is subject to a pressure based on a fan and/or a pressure connection arranged in or at its walls or effective there. Accordingly, the aerosol created by an ultrasound atomizer can be transported to its target location in a continuous fashion.

Here, it is particularly advantageous when one or more, for example two, ultrasound atomizers, are provided at the liquid reservoir. The surface of the liquid reservoir and the liquid contained therein can therefore be appropriately large and create an accordingly large amount of aerosol so that correspondingly large shooting units can be kept moist simultaneously even at several sites.

A mobile protective device with a rinsing hood may be allocated to the shooting head, provided with the connection for the aerosol and being removable or separable for the individual shots, and the connection line from the ultrasound atomizer and the liquid reservoir to the protective device can be embodied as a telescopic tube or a hose. This way, the possibility remains to provide a mobile protective device and rinsing hood, because it can be connected via mobile lines following the motions of the protective device.

It can be advantageous for the shooting tube and/or the shooting head of the shooting unit to be connected to the ultrasound atomizer and the liquid reservoir via one or more lines. In this way, a crust formation at the surface of the sand supply, particularly in the shooting tube, can be avoided. Further, in this way the sand supply can be moistened in a targeted fashion such that at the discharge opening or shooting opening only a slight feeding or perhaps none at all of the moisture is necessary, but rather the moisture is fed to the area of the shooting opening via the sand supply. Therefore, a direct or an indirect feeding of aerosol to the shooting opening (s) can be provided, with a combination of both promising the best results.

BRIEF DESCRIPTION OF THE DRAWING

In the following, an exemplary embodiment of the invention is described in greater detail using the drawing. The sole FIGURE shows: in a schematic representation, a longitudinal cross-sectional view through a shooting unit to feed a mixture of sand or moulding material and a binder to a core tool, also shown schematically in a vertical cross-section, with one line each opening in a protective device with a gas rinsing hood allocated to a shooting unit, on the one hand, and a shooting tube allocated to the shooting unit, on the other side, originating at a liquid reservoir with an ultrasound atomizer and serving to moisten the shooting opening and the sand supply.

DETAILED DESCRIPTION OF THE PREFERRED EMBODIMENT

Figure 1:
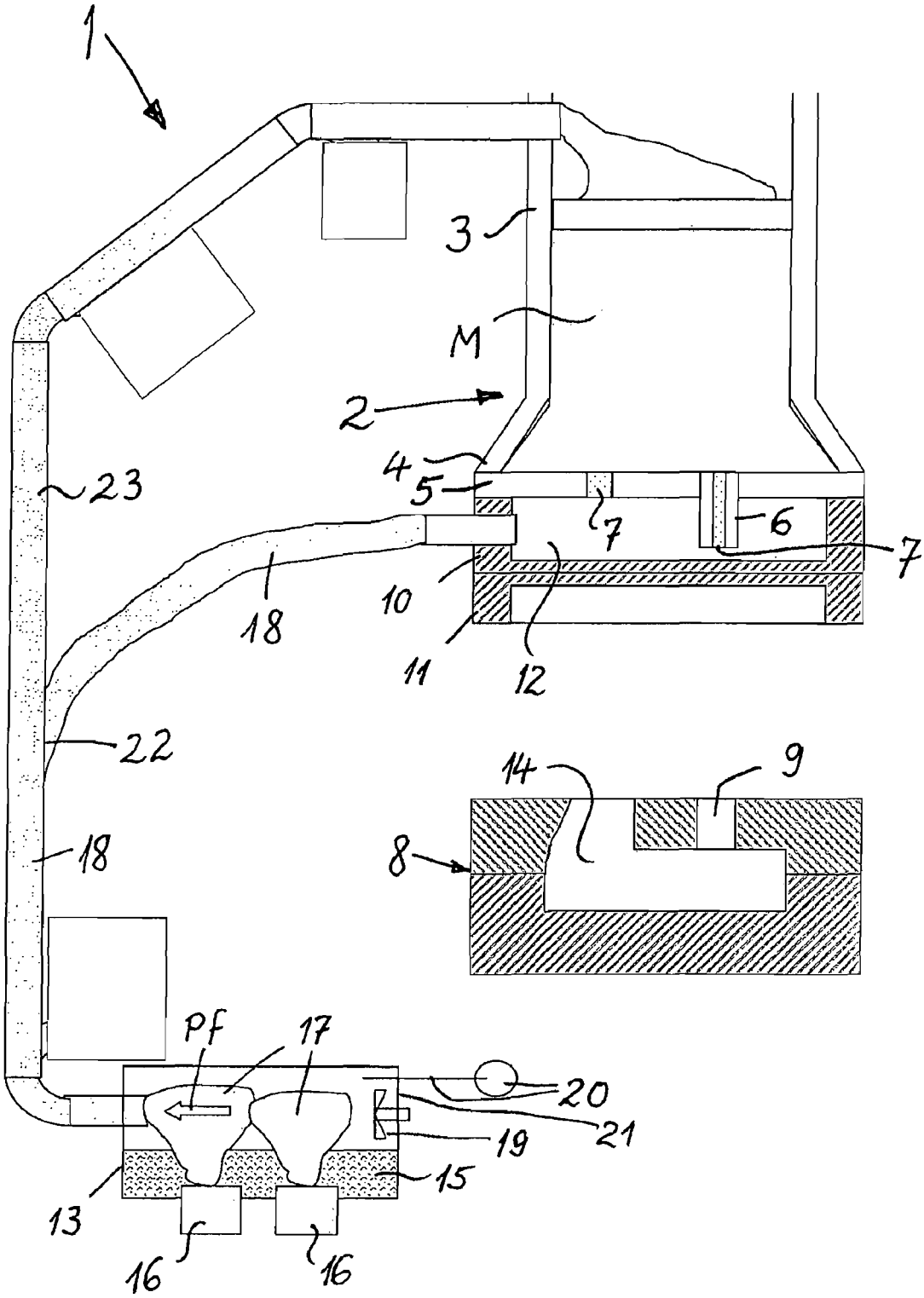

A device to produce moulds and cores, indicated as 1 in its entirety, which in the exemplary embodiment is used to produce cores for foundry purposes, from a mixture M comprising sand or a moulding material and a particularly water-soluble or hydroscopic binder, is provided with a shooting unit, indicated as 2 in its entirety, essentially comprising a shooting tube 3 that accepts the mixture M and a shooting head 4.

At the bottom end of the shooting head 4, a shooting plate 5 is arranged, above which the mixture M is located, which can be shot in a shooting process through at least one shooting nozzle 6 with a shooting opening 7 as well as, in the exemplary embodiment, another shooting opening 7 out of the shooting unit 2 into a core tool 8. For this purpose, in a manner known per se, the shooting tube 3 is impinged with pressure from above such that the mixture M is driven through the shooting nozzle 6, fitting into the input opening 9 of the core tool 8, out of the space located above the shooting plate 5 and is enclosed in the space 14 in the core tool 8 provided to accept the mixture and fills it.

In the drawing, the device 1 is shown in a state after a shooting process, i.e. the shooting unit 2 and the core tool 8 are separated and at a distance from each other.

In order to prevent remnants of the mixture left in the shooting nozzle 6 and/or the shooting opening 7 and the mixture M located above the shooting plate 5 from crusting in the time until the next shot and primarily from plugging up the discharge openings 7 by the partially hardened mixture, they are moistened in the following manner.

Between the shooting unit 2 and the core tool 8, a mobile protective unit 10 with a gas rinsing hood 11 is provided. The protective device 10 is provided with a hollow space 12. When the device is connected to the shooting plate 5 in the manner shown it overlaps the plate and particularly the shooting openings 7 and also the shooting nozzle 6 projecting into the hollow space 12. Here, the hollow space 12 is sealed from the shooting plate 5 in an air-tight or almost air-tight manner from the environment.

Further, in the FIGURE a reservoir 13 is discernible for liquids 15 and two ultrasound atomizers 16, shown schematically and acting on the liquid 15, connected to the liquid reservoir 13. In this way, the liquid 15 comprising or containing water is transformed into a suspended aerosol, which is indicated as a "mushroom cloud" 17 above the surface of the liquid 15.

The ultrasound atomizer 16 and the liquid reservoir 13 are connected to the hollow space 12 of the protective device 10 via a tube 18 and thus to the shooting openings 7 such that they are moistened by the suspended aerosol but are not saturated by precipitating water.

Here, it is discernible that the ultrasound atomizer 16 and the liquid reservoir 13 are arranged spatially separated from the shooting unit 2 and are connected to the area of the shooting openings 7 via a tubular or hose line 18. In this way, the creation of a suspended aerosol 17 can occur at a location offering sufficient space for this purpose.

In order to transport the aerosol 17 from the ultrasound atomizers 16 and the liquid reservoir 13 to the shooting openings 7 of the shooting unit 2, in the exemplary embodiment a fan 19 and a pressure connection 20 are indicated, with both possibilities may be provided alternatively or simultaneously.

Here, the fan 19 and/or the pressure connector 20 are located above the surface of the liquid 15 in the liquid reservoir 13, which is embodied as a closed liquid vessel, so that above the liquid 15 a pressure can be created by the fan 19 or the pressurized gas connection 20, serving to transport the aerosol 17. The pressurized gas connection 20 or the fan 19 are here arranged at or in a wall 21 of the liquid reservoir 13, which is embodied as a liquid vessel.

Here, it is discernible in the exemplary embodiment that two ultrasound atomizers 16 are provided at the liquid reservoir 13, which are covered by the liquid 15 and thus can create two "aerosol clouds" 17, both of which can be transported in the line 18 in the direction of the arrow Pf.

Due to the fact that the protective device 10 with the gas rinsing hood 11 is mobile in reference to the shooting unit 2 and the shooting plate 5, the line 18 leading thereto is embodied as a hose, capable of following the respective motions. In this way, the protection device 10 with the rinsing hood 11 allocated to the shooting head 4 and the shooting plate 5 can be removed and transported away from the shooting plate 5 for the individual shots, in spite of the connection for the aerosol and in spite of the line 18 leading to this connection.

Here, it is discernible in the drawing that the line 18 has a fork 22 and another line 23 leading to and into the shooting tube 3 so that the aerosol formed by the ultrasound atomizer 16 can also be transported in or via the mixture M in order to prevent the surface of the mixture from crusting in this reservoir. Furthermore, in this way the entire mixture can be kept moist right from the start, which also prevents crusting in the shooting openings 7.

Using the device 1 according to the invention it is also possible to atomize the liquid 15 serving to moisten, for example water, into a suspendable aerosol via ultrasound and directly or indirectly feed it to the area of the shooting opening 7 or the shooting openings 7. The direct feeding occurs in the exemplary embodiment via the line 18 and the protection device 10 with its hollow space 12 and the indirect supply occurs via the line 23 and the shooting tube 3.

In a manner not described in greater detail, the aerosol and the volume of the flow provided with the aerosol can be adjusted by changing the pulse packages emitted by the ultrasound generators 16 and/or by changing the voltage of the ultrasound generator 16.

Due to the fact that the shooting unit 2 is connected to the liquid reservoir 13 and the ultrasound atomizer 16 via the hose 18 and the line 23, the suspendable aerosol is formed at a distance from the shooting openings 7 and guided thereto via the lines mentioned.

Here, the aerosol 17 created by ultrasound results in such small liquid particles that they transfer into humidity, and thus can serve to moisten the mixture M at least in the area of the shooting openings 7, without precipitating as wetness and potentially even saturating the mixture M in an uneven manner and thus potentially rinsing out or dissolving the binders.

In order to produce moulds or cores for foundry purposes from a mixture M from a moulding material or sand and a binder, a mixture M is shot out of at least one shooting unit 2 and/or out of a shooting pipe 3 and a shooting head 4 through at least one shooting opening 7 arranged at a shooting plate 5 into a moulding or core tool 8, with at least between two shooting processes, the area of the shooting opening 7 is moistened and/or kept moist by a liquid, and the liquid 15 that is used for moistening is atomized by at least one ultrasound mister 16 into a suspendable aerosol and directly or indirectly fed to the shooting opening 7, for example via the line 18 and/or 23.

The invention claimed is:

1. A method to produce moulds or cores from a mixture (M) comprising sand or moulding material and a binder, comprising shooting the mixture (M) via at least one shooting unit (2) from said unit through at least one shooting opening (7) arranged at a shooting plate (5) into a moulding or core tool (8) and subsequently hardening the mixture, and at least between two shooting processes moistening an area of the at least one shooting opening (7) via a liquid or water or keeping the area of the at least one shooting opening (7) moist, and atomizing the liquid or water (15) serving to moisten the area via ultrasound so that the liquid or water is a suspendable aerosol that is fed to the area of the at least one of the shooting opening (7), or the shooting unit (2) or the shooting head.

2. A method according to claim 1, wherein the aerosol and a volume of a flow comprising the aerosol can be adjusted by changing pulse packages emitted by an ultrasound generator or by changing a voltage of the ultrasound generator (16).

3. A method according to claim 1, wherein the suspendable aerosol is formed at a distance from the at least one shooting opening and is fed to the at least one shooting opening via a line.

4. A method according to claim 1, wherein the sand in the shooting tube or in the shooting head is moistened with the suspendable aerosol.

* * * * *